US007366317B2

(12) United States Patent
Miller et al.

(10) Patent No.: US 7,366,317 B2
(45) Date of Patent: Apr. 29, 2008

(54) APPARATUS FOR CREATING MOTION AMPLIFICATION IN A TRANSDUCER WITH IMPROVED LINKAGE STRUCTURE

(75) Inventors: Thomas Edward Miller, Arlington Heights, IL (US); David E. Schafer, Glen Ellyn, IL (US)

(73) Assignee: Knowles Electronics, LLC, Itasca, IL (US)

( * ) Notice: Subject to any disclaimer, the term of this patent is extended or adjusted under 35 U.S.C. 154(b) by 556 days.

(21) Appl. No.: 10/967,959

(22) Filed: Oct. 18, 2004

(65) Prior Publication Data

US 2006/0083400 A1 Apr. 20, 2006

(51) Int. Cl.
*H04R 1/00* (2006.01)
*H04R 9/06* (2006.01)
*H04R 11/02* (2006.01)

(52) U.S. Cl. ..... 381/396; 381/398; 381/418

(58) Field of Classification Search ..... 381/312, 381/322, 328, 396, 412, 417–419, 421, 422
See application file for complete search history.

(56) References Cited

U.S. PATENT DOCUMENTS

| | | | |
|---|---|---|---|
| 2001/0012375 | A1 | 8/2001 | Miller et al. |
| 2004/0167377 | A1 | 8/2004 | Schafer et al. |
| 2004/0168852 | A1 | 9/2004 | Jiles et al. |
| 2004/0258260 | A1 | 12/2004 | Thompson et al. |
| 2005/0002542 | A1 | 1/2005 | Warren et al. |

FOREIGN PATENT DOCUMENTS

| | | | |
|---|---|---|---|
| WO | WO-01/52594 | A2 | 7/2001 |
| WO | WO-2004/030406 | A1 | 4/2004 |
| WO | WO-2004/049756 | A1 | 6/2004 |

OTHER PUBLICATIONS

International Search Report for Application No. PCT/US2005/008402 dated Jul. 29, 2005.
Pending U.S. Appl. No. 10/867,340, filed Jun. 12, 2004, Miller et al., commonly assigned to Knowles Electronics, LLC.

*Primary Examiner*—Curt Kuntz
*Assistant Examiner*—Tuan D Nguyen
(74) *Attorney, Agent, or Firm*—Marshall, Gerstein & Borun LLP

(57) ABSTRACT

Various linkage assemblies are shown and described for connecting a first movable member to a second movable member of a transducer. The linkage assemblies provide for motion amplification or reduction and, when used for sound generating purposes such as hearing aids or speakers, three different schemes for compensating for amplification-induced distortion. One scheme for compensating for distortion while providing amplification is the use of a lower horizontal span segment in a closed-loop linkage assembly that is longer than a corresponding upper horizontal span segment or upper vertex. Thus, a horizontal span segment used to connect the loop to the first movable member of the armature is longer than a corresponding segment or vertex used to connect the loop to the second movable member. A second distortion compensating feature that provides amplification is found in the use of non-parallel legs used to connect the linkage loop to the housing. The legs extend from vertices that connect the upper and lower portions of the loop together and they extend inwardly toward each other in a non-parallel fashion as they extend from the vertices to the bottom panel of the housing. Finally, a third scheme involves the manipulation of the effective height of the upper and lower portions of the closed loop. By providing a lower portion of the closed loop with a greater effective height or length than the upper portion, amplification is provided with a distortion effect that can be used to counterbalance distortion effects generated by other features of the linkage assemblies. The converse of all three schemes can be used for motion or gain reduction as well.

33 Claims, 15 Drawing Sheets

APPARATUS FOR CREATING MOTION AMPLIFICATION IN A TRANSDUCER WITH IMPROVED LINKAGE STRUCTURE

TECHNICAL FIELD

Transducers, including but not limited to those used in listening devices, such as hearing aids or the like are disclosed. More particularly, an improved linkage assembly for use in a transducer is disclosed.

BACKGROUND

There are several different types of hearing aid styles widely known in the hearing aid industry and described with the following designations: behind-the-ear (BTE), in-the-ear or all in-the-ear (ITE), in-the-canal (ITC), and completely-in-the-canal (CIC).

Hearing aid technology has progressed rapidly in recent years. Technological advancements in this field continue to improve the reception, wearing-comfort, life-span, and power efficiency of hearing aids. However, even with these continual advances in the performance of hearing aids, there is still a continuous demand for improving the performance of the miniature acoustic transducers that are utilized in hearing aids and other similar applications. Therefore, disclosure will be directed primarily at hearing aid transducers in addition to miniature transducers in general.

A listening device, such as a hearing aid, includes a microphone, an amplifier and a transducer (also commonly referred to as a "receiver" or simply, a "speaker"). The microphone receives acoustic sound waves and creates an electronic signal representative of these sound waves. The amplifier accepts the electronic signal, modifies the electronic signal, and communicates the modified electronic signal (e.g. processed signal) to the transducer. The transducer, in turn, converts the processed electronic signal into acoustic energy for transmission to the user's ear.

Conventionally, a hearing aid transducer includes a housing, a sound outlet port, an electrical terminal, at least one diaphragm, a magnet assembly, and a motor assembly. The magnet assembly includes a magnetic yoke and a pair of drive magnets attached to the magnetic yoke. The motor includes an armature, at least one linkage assembly, a drive coil, and a lead connecting the coil to the terminal. When an alternating current is supplied to the coil via the terminal, the armature vibrates in response to the magnetic field generated by the motor assembly. The vibration of the armature is transmitted via the linkage assembly to the diaphragm, which causes sound vibrations that are transmitted to the user.

Conversely, sound vibrations vibrate the diaphragm causing the armature to vibrate via the linkage assembly. This vibration generates an electric alternating current in the coil. The electrical signal is then transmitted out through the terminal, detected and processed accordingly.

Typically the linkage assembly connecting the armature and the diaphragm may be of a motion-redirection type disclosed in U.S. patent application Ser. No. 09/755,664, which is a continuation-in-part of U.S. patent application Ser. No. 09/479,134, now abandoned, U.S. patent application Ser. No. 10/719,809, U.S. patent application Ser. No. 10/719,765, U.S. patent application Ser. No. 10/842,654 and U.S. patent application Ser. No. 10/842,663, the disclosures of which are all incorporated herein by reference.

The motion-redirection linkage is usually a four-sided or a six-sided linkage assembly supported by a pair of upright supporting members. The linkage assembly includes an upper portion and a lower portion each having a plurality of link members that transmit motion to the diaphragm in response to that of the armature. The motion of the diaphragm will be equal and opposite to that of the armature if the upper portion of the link is identical in shape and size as the lower portion of the link.

However, the sound pressure output is limited by the area and displacement of the diaphragm and the displacement of the diaphragm is limited by the motor assembly including the armature and the linkage. Attempts to increase the displacement of the diaphragm to amplify this sound cause unwanted distortion.

Therefore, there is a need for an improved transducer which incorporates a linkage design that can amplify the sound output of the diaphragm without causing substantial distortion. Methods for amplifying diaphragm output are also needed that compensate for or counteract distortions generated by such attempts at amplification.

Further, there is a need for improved transducers used in receivers, microphones, speakers, accelerometers, Micro-Electro-Mechanical Systems (MEMS) devices or any other device where motion amplification is desirable.

BRIEF DESCRIPTION OF THE DRAWINGS

For a more complete understanding of the disclosed linkage assemblies, reference should be made to the following detailed description and accompanying drawings, wherein.

Figure 1:
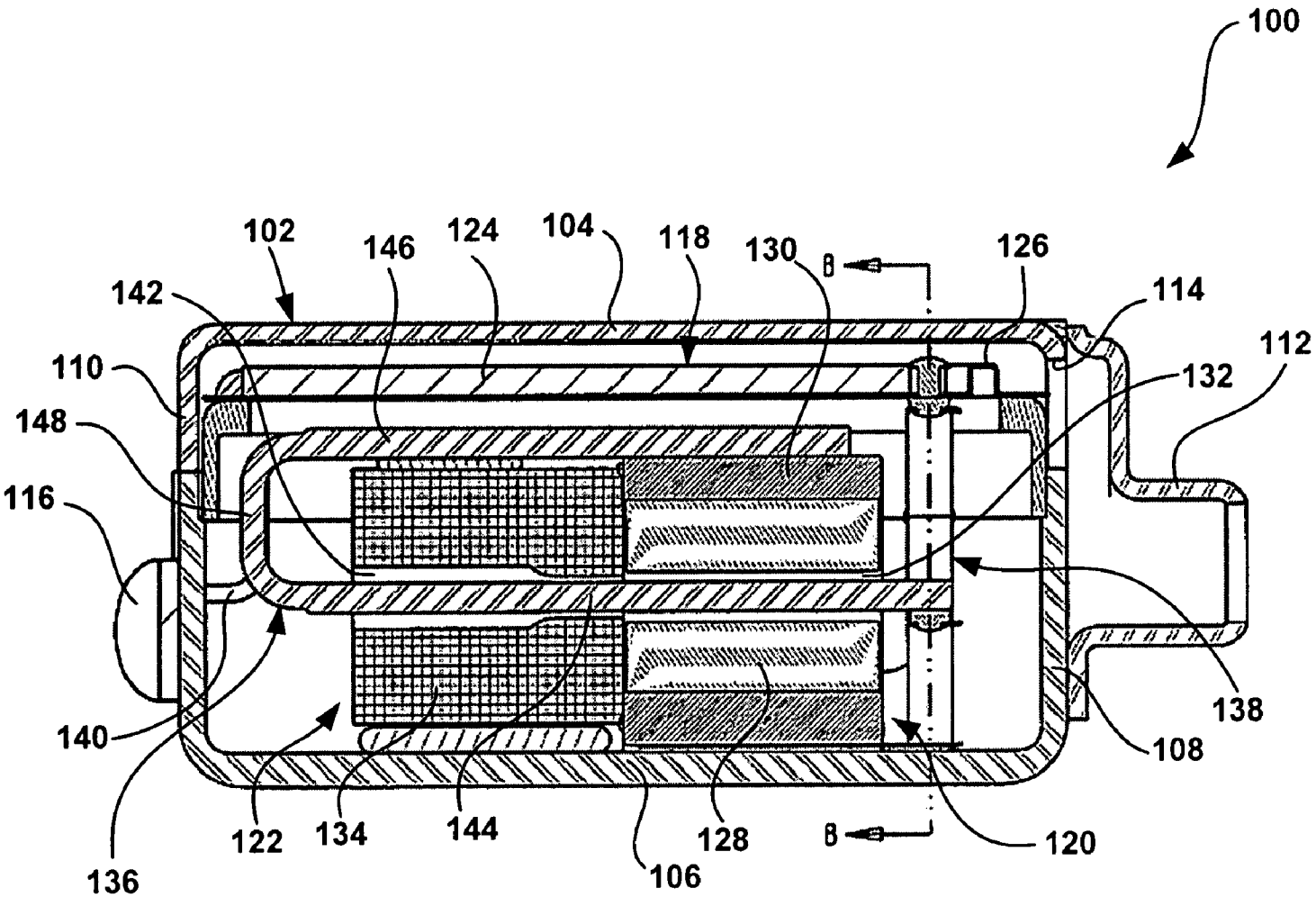
FIG. 1 is a cross-sectional view of a disclosed receiver assembly.

The drawings are not necessarily to scale and the disclosed embodiments are sometimes illustrated by graphic symbols, phantom lines, diagrammatic representations and fragmentary views. In certain instances, details in the drawings may have been omitted which are not necessary for an understanding of the disclosed linkage assemblies or the methods of amplifying the output of the transducers using the linkage assemblies while compensating for distortion. It should be understood that this disclosure is not limited to the particular embodiments illustrated in the drawings and disclosed herein. In short, numerous modifications will be apparent to those skilled in the art which fail within the spirit and scope of this disclosure and the appended claims.

DETAILED DESCRIPTION OF THE PRESENTLY PREFERRED EMBODIMENTS

FIG. 1 illustrates one embodiment of a transducer 100 that, while particularly useful for a hearing aid, the design of the transducer 100 may also be used in a microphone, receiver, speaker, accelerometer, MEMS devices or other such devices where motion amplification or moderation between two members is desired. The transducer 100 may be useful in such devices as hearing aids, in-ear monitors, headphones, electronic hearing protection devices, very small scale acoustic speaker and MEMS devices.

The transducer 100 includes a housing 102 consisting of a cover 104 and a base 106 attached to the cover 104 by any suitable method of attachment. The cover 104 and base 106 of the housing 102 may have a rectangular-shaped cross-section with a front side 108 and a back side 110. One of the sides of the housing 102 such as the front side 108 is connected to at least one sound outlet port 112 for transmitting the acoustic signal to the user.

In other embodiments, the housing 102 can be manufactured in a variety of shapes, such as a cylindrical, a D-shaped, a trapezoid, a roughly square, a tubular, or any desired geometry. The scale and size of the housing 102 may vary based on the intended application, operating conditions, required components, etc.

A damping element or filter (not shown) may be positioned within the sound outlet port 112. Such a filter may provide an acoustical resistance, may improve the frequency response, may create delay, and may prevent debris from entering the transducer 100.

An opening 114 is provided in the front side 108 of the housing 102 to allow communication between the working components within the housing 102 and the ear canal or outer surroundings via the sound outlet port 112. The opening 114 may be formed in any suitable manner such as drilling, punching, or molding. In other embodiments, the opening 114 can be formed on one of any walls of the housing 102, and the sound outlet port 112 corresponding to the opening 114 may be coupled to such a wall depending on the intended application.

An optional electrical terminal assembly 116 may be affixed to the back side 110 of the housing 102 by bonding, welding, soldering or any other suitable method of attachment. The electrical terminal assembly 116 receives an electrical input signal that is converted by the working components within the housing 102 to an acoustic signal which is broadcast through outlet port 112.

The transducer 100 may further include a diaphragm 118, a magnet assembly 120, and a motor assembly 122. The diaphragm 118 disposed within the housing 102 includes a paddle 124 and a thin flexible film 126 attached to the paddle 124 by any suitable method of attachment. An outer edge portion (not shown) of the diaphragm 118 may be adhesively secured to the inner wall of the housing 102. The paddle 124 is shown to have at least one layer. However, the paddle 124 may utilize multiple layers disclosed in U.S. patent application Ser. Nos. 10/719,809 and 10/719,765, the disclosures of which are incorporated herein by reference.

The magnet assembly 120 includes a pair of drive magnets 128 to provide sufficient magnetic flux. The drive magnets 128 are attached to a magnetic yoke 130. The drive magnets 128 may be made of a magnetic material such as Ferrite, Alnico, a Samarium-Cobalt alloy, a Neodymium-Iron-Boron alloy, or of any similar materials disclosed in U.S. patent application Ser. No. 10/867,340, the disclosure of which is incorporated herein by reference. The magnet assembly 120 may generally be shaped to correspond to the shape and configuration of the housing 102 but may be formed to compliment the various shape and sizes of the different embodiments. The yoke 130 forms a rectangular frame having a central tunnel or channel defining an enclosure into which the drive magnets 128 are mounted and define a fist air gap 132 to carry the electromagnetic flux of the drive magnets 128. The yoke 130 may be made of a Nickel-Iron alloy, an Iron-Cobalt-Vanadium alloy or of any similar materials disclosed in U.S. patent application Ser. No. 10/867,340, the disclosure of which is incorporated herein by reference.

The motor assembly 122 includes a drive coil 134, an armature 136, a linkage 138, and a lead 140 connecting the coil 134 to the electrical assembly 116. The audio signals are transmitted to the transducer 100 through the electrical terminal 116 which is attached to the drive coil 134 via the lead 140. The drive coil 134 defines an air gap 142 and the magnet assembly 120 defines the air gap 132 that is aligned with the air gap 142 as shown in FIG. 1.

In the embodiment shown in FIG. 1, the armature 136 is a generally U-shaped strap. One of ordinary skill in the art will appreciate that the armature 136 may be E-shaped or of a different configuration. The armature 136 comprises a movable leg 144 extending through the first and second air gaps 132, 142 and a fixed leg 146 secured outside the magnetic yoke 130 as depicted in FIG. 1. A connecting end 148 is attached between the movable and fixed legs 144, 146 and is positioned on a rear side of the drive coil 134. The movable leg 144, the fixed leg 146, and the connecting end 148 are made of a metallic material, and can be integrally formed from a blank. The movable leg 144 is coupled to the linkage 138, which in turn is coupled to the diaphragm 118. The linkage 138 is typically fabricated from a flat stock material such as a thin strip of metal or foil. The linkage 138 may be formed into a variety of shapes and configurations based on the intended application, operating conditions, required component, etc to amplify motion or force, which will be discussed in greater detail. Alternatively, the linkage 138 may be formed of plastic or some other material.

When the transducer 100 is used as a speaker such as in a hearing aid application, a current representing an input audio signal from the electrical terminal assembly 116 is supplied to the drive coil 134 via the lead 140. The movable leg 144 of the armature 136 vibrates in response to the electromagnetic forces generated by the magnetic flux produced by the magnet assembly 120 mid the drive coil 134, which in turn leads to the movement of the linkage 138. The diaphragm 118 moves in response to the corresponding motion of the linkage 138, which in turn generates an output acoustical signal directed through the port 112 and to the user.

Conversely, when the transducer 100 is used as a microphone, acoustical signals vibrating the diaphragm 118 are transmitted to the movable leg 144 of the armature 136 via the linkage assembly 138, and the vibrating movable leg 144 causes an electric alternating electric current in the drive coil 134. The alternating electric current may be detected and processed accordingly.

This disclosure is not limited to the type of transducer illustrated in FIG. 1. As noted above, this disclosure is directed to the amplification or reduction of motion between two movable members 144 and 118 by way of a linkage 138. The concepts disclosed herein are therefore applicable to hearing aids, receivers, microphones, speakers, accelerometers, MEMS devices or any other device where motion amplification or reduction is desirable. Thus, the movable legs 144-1344 of the armatures 136-1336 discussed herein are more generally considered to be first movable members as they initiate the motion to be transferred. Further, the diaphragms 118-1318 discussed herein are more generally considered to be second movable members as they are the elements to which the motion of the first movable members 144-1344 is transferred. The first and second movable members 144-1344, 118-1318 respectively may be in the form of an armature, diaphragm, voice coil, cone, piezoelectric element, moving magnet, magnetostrictive element, etc.

The following FIGS. 2-15 are taken generally along the line B-B in FIG. 1, where construction details discussed above will not be represented or will be represented only schematically. In FIGS. 2-15, equal or similar parts will be designed by equal reference numerals, with the understanding that the 'hundreds' digit or the first digit in the reference numeral for FIGS. 1-9 corresponds to the number of the figure in question and the thousands and hundreds digits, or the first two digits, of each reference numeral in FIGS. 10-15 also corresponds to the figure number. Reference will be made below to an orthogonal coordinate system, the x-axis of which is directed according to the horizontal movement of the vertex of the linkage assembly, whereas the y-axis is directed according to the vertical movement of the members of the linkage assembly.

Figure 2:
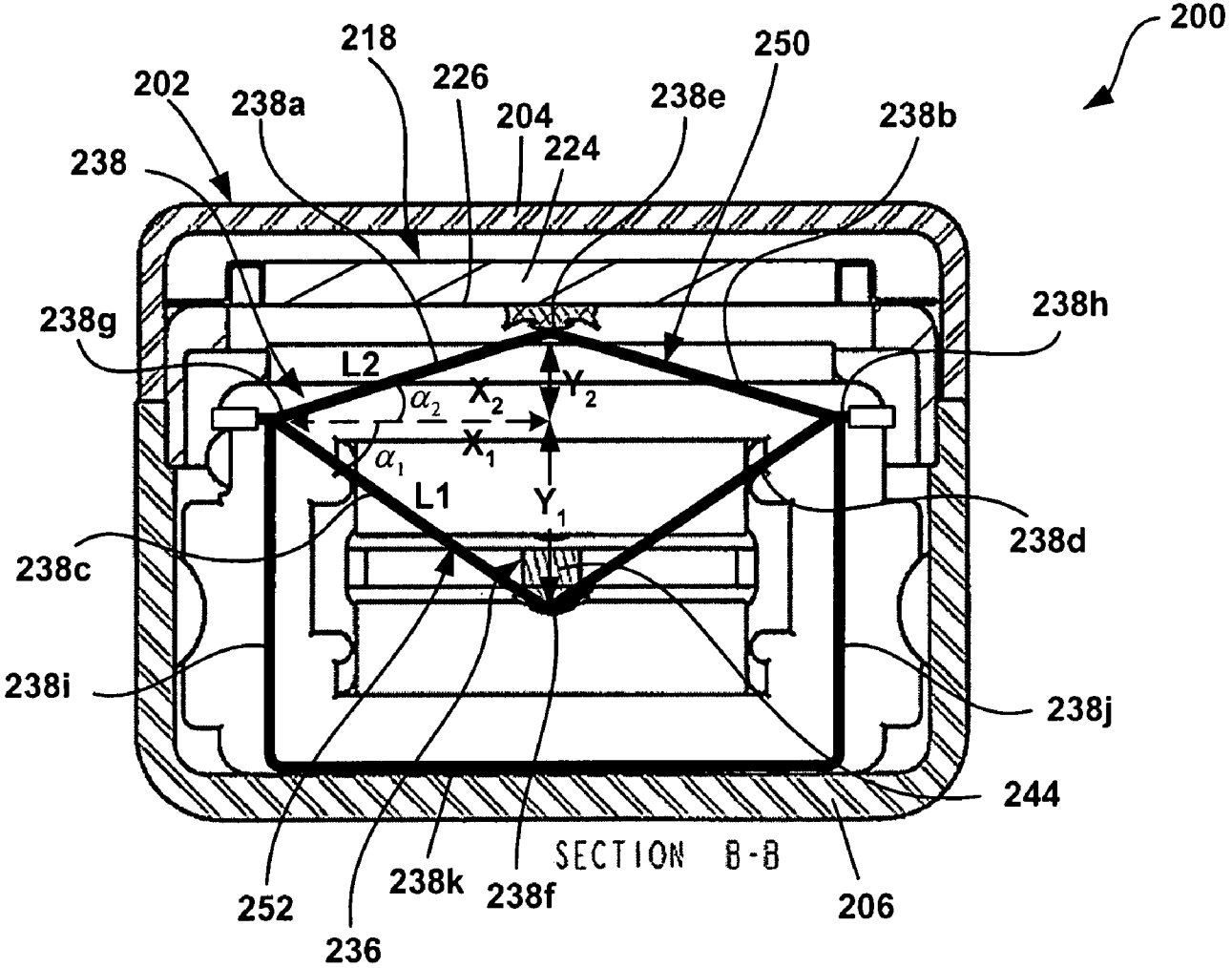
FIGS. 2-3 are cross-sectional views of two disclosed linkage assemblies.
Figure 3:
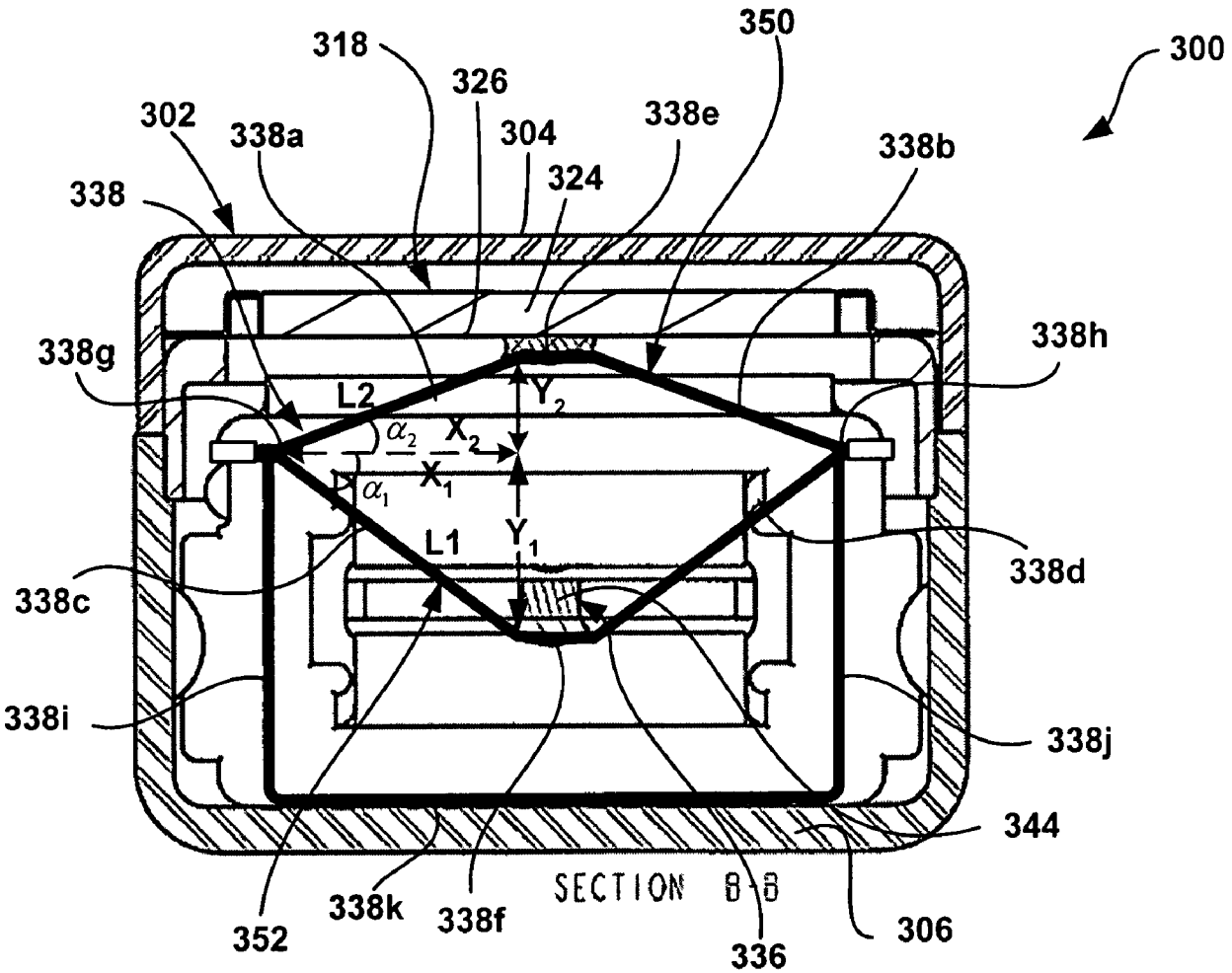

FIGS. 2-3 illustrate two related embodiment of linkage assemblies 238, 338. The linkage assemblies 238, 338 may be utilized in a microphone, a receiver, a speaker, an accelerometer, a MEMS device or other such device where motion amplification is desired.

Turning to FIG. 2, the linkage assembly 238 is configured as a generally four-sided closed loop comprising an upper portion 250 and a lower portion 252 and with four side members 238*a*-238*d*. In alternate embodiment shown in FIG. 3, the linkage assembly 338 is configured as a generally six-sided closed loop with upper and lower portions 350, 352 respectively and six side members 338*a*-338*f*.

The upper portions 250, 350 each comprise a plurality of diagonal members 238*a*, 238*b*, 338*a*, 338*b* and a first vertex 238*e* or horizontal span segment 338*e* attached to the members 238*a*, 238*b*, 338*a*, 338*b*. The lower portions 252, 352 comprise a plurality of diagonal members 238*c*, 238*d*, 338*c*, 338*d* and a second vertex 238*f* or horizontal span segment 338*f* attached to the members 238*c*, 238*d*, 338*c*, 333*d*. The upper and lower portions 250, 252, 350, 352 are connected together at a third and fourth vertices 238*g*, 238*h*, 338*g*, 338*h*.

In FIG. 2, the diagonal members 238*a*, 238*b*, 238*c*, 238*d* are shown substantially straight and connected together at the vertices 238*e*, 238*f*, 238*g*, 238*h* having sharp angle. In FIG. 3, the diagonal members 338*a*, 338*b*, 338*c*, 338*d* are shown substantially straight and connected together at the segments 338*e*, 338*f* having a predetermined length or span as shown in FIG. 3.

In the embodiments 200, 300 of FIGS. 2-3, the length of the upper members 238*a*, 238*b*, 338*a*, 338*b* is shorter than the length of the lower members 238*c*, 238*d*, 338*c*, 338*d* such that the height of the upper portions 250, 350 defined as $Y_2$ is shorter than the height of the lower portions 252, 352 defined as $Y_1$. The movable legs 244, 344 of the armatures 236, 336 are operably attached to the lower portions 252, 352 of the linkage assemblies 238, 338 at or near the vertex 238*f* or segment 338*f* by any suitable form of attachment. The diaphragms 218, 318 are operably attached to the upper portions 250, 350 of the linkage assemblies 238, 338 at or near the vertices 238*e*, 338*e* by any suitable form of attachment.

The motion of vertices 238*g*, 238*h*, 338*g*, 338*h* of the linkage assemblies 238, 338 are partially constrained by first and second vertical legs 238*i*, 238*j*, 338*i* 338*j* of the linkage assemblies 238, 338 which are perpendicular to the bases 206, 306, thus restricting movement of the vertices 238*g*, 238*h*, 338*g*, 338*h* in a direction parallel to the first and second legs 238*i*, 238*j*, 338*i*, 338*j* of the linkages 238, 338 respectively. The connecting base legs 238*k*, 338*k* which connect the first and second vertical legs 238*i*, 238*j*, 338*i*, 338*j* together and are adhesively secured to the inner wall of the housing base 206, 306 as depicted in FIGS. 2-3. In an alternative embodiment, the connecting base legs 2381*k*, 338*k* may be removed such that the first and second vertical legs 238*i*, 238*j*, 338*i*, 338*j* are secured to a stationary surface, such as the inner surface of the bases 206, 306.

In operation, upward movement by the movable legs 244, 344 of the armatures 236, 336 generate an upward movement of the lower portions 252, 352 of the linkages 238, 338, which in tar generate a horizontal outward movement of vertices 238*g*, 238*h*, 338*g*, 338*h*. The outward movement of vertices 238*g*, 238*h*, 338*g*, 338*h* causes the upper portions 250, 350 to move downwardly toward the lower portions 252, 352. This in turn causes the diaphragms 218, 318 to move inwardly toward the movable ends 244, 344 of the armatures 236, 336, or in opposite direction to movable legs 244, 344.

The motion of the upper vertex 238*e* or segment 338*e* is calculated as follows, where $L_1$ represents the length of members 238*c*, 238*d*, 338*c*, 338*d*, $X_1$ represents the horizontal portion of the length $L_1$, $Y_1$ represents the vertical portion of length $L_1$, and $\alpha_1$ represents the angle between the members and the horizontal plane.

$$X_1 = L1 \cdot \mathrm{Cos}(\alpha_1) \tag{1}$$

$$Y_1 = L1 \cdot \mathrm{Sin}(\alpha_1) \tag{2}$$

Differentiating equations (1) and (2) with respect to alpha ($\alpha$) shows the change in X and Y distances when a small change is made in the position of the lower vertex 238*f* or segment 338*f*.

$$\frac{dX_1}{d\alpha_1} = -Ll \cdot \sin(\alpha_1) \tag{3}$$

$$\frac{dY_1}{d\alpha_1} = Ll \cdot \cos(\alpha_1) \tag{4}$$

Combining equations (3) and (4) using substitutions yields an equation showing the relationship between changes in the vertical position of vertex 238*f* or segment 338*f*, and the side vertices 238*g*, 238*h*, 338*g*, 338*h*.

$$\frac{dX_1}{dY_1} = -\tan(\alpha_1) \tag{5}$$

A similar derivation can be used to calculate the relationship between the top vertex 238*e* or segment 338*e* and the side vertices 238*g*, 238*h*, 338*g*, 338*h*, where $Y_2$ represents the vertical portion of members 238*a*, 238*b*, 338*a*, 338*b*, $X_2$ represents the horizontal portion of the length $L_2$, and $\alpha_2$ represents the angle between the linkages and the horizontal plane $$\frac{dX_2}{dY_2} = -\tan(\alpha_2) \tag{6}$$

Equations (5) and (6) can be combined using substitution to show the relationship between motion at the top vertex 238*e* or segment 338*e* and the motion at the lower vertex 238*f* or segment 338*f*, e.g. $dX_1=dX_2$ which is the lever ratio of the linkages $$\frac{dY_2}{dY_1} = \frac{\tan(\alpha_1)}{\tan(\alpha_2)} \tag{7}$$

Equation (7) shows that the desired lever ratio can be set by choosing the lengths $L_1$ and $L_2$ to create appropriate values for $\alpha_1$ and $\alpha_2$. However, the lever ratio changes as the vertices move and the angles change, resulting in distortion unless file two angles are equivalent to each other. The two angles will continue to match each other if $L_1$ and $L_2$ match.

Figure 4:
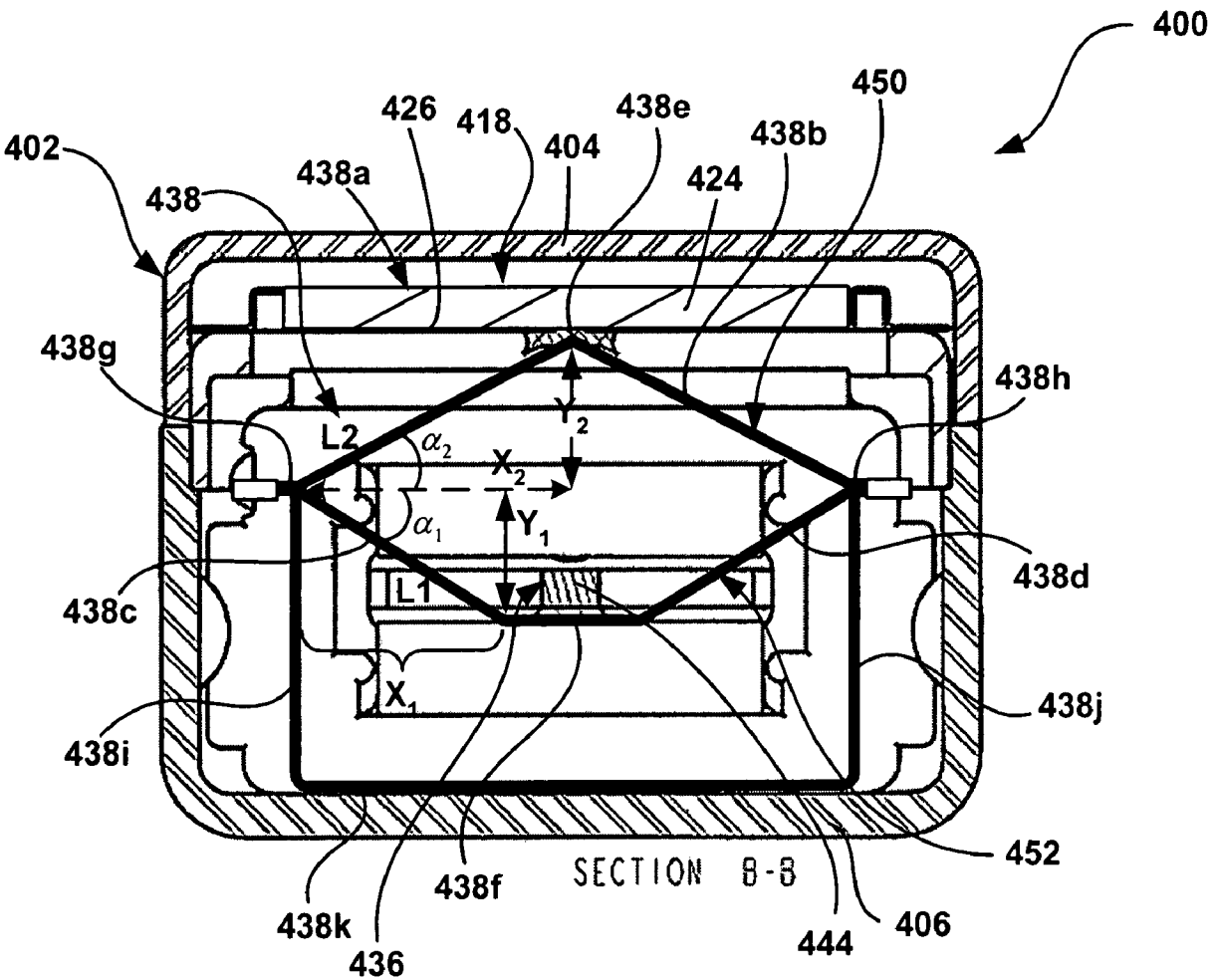
FIGS. 4-5 are cross-sectional views of a two more disclosed linkage assemblies.
Figure 5:
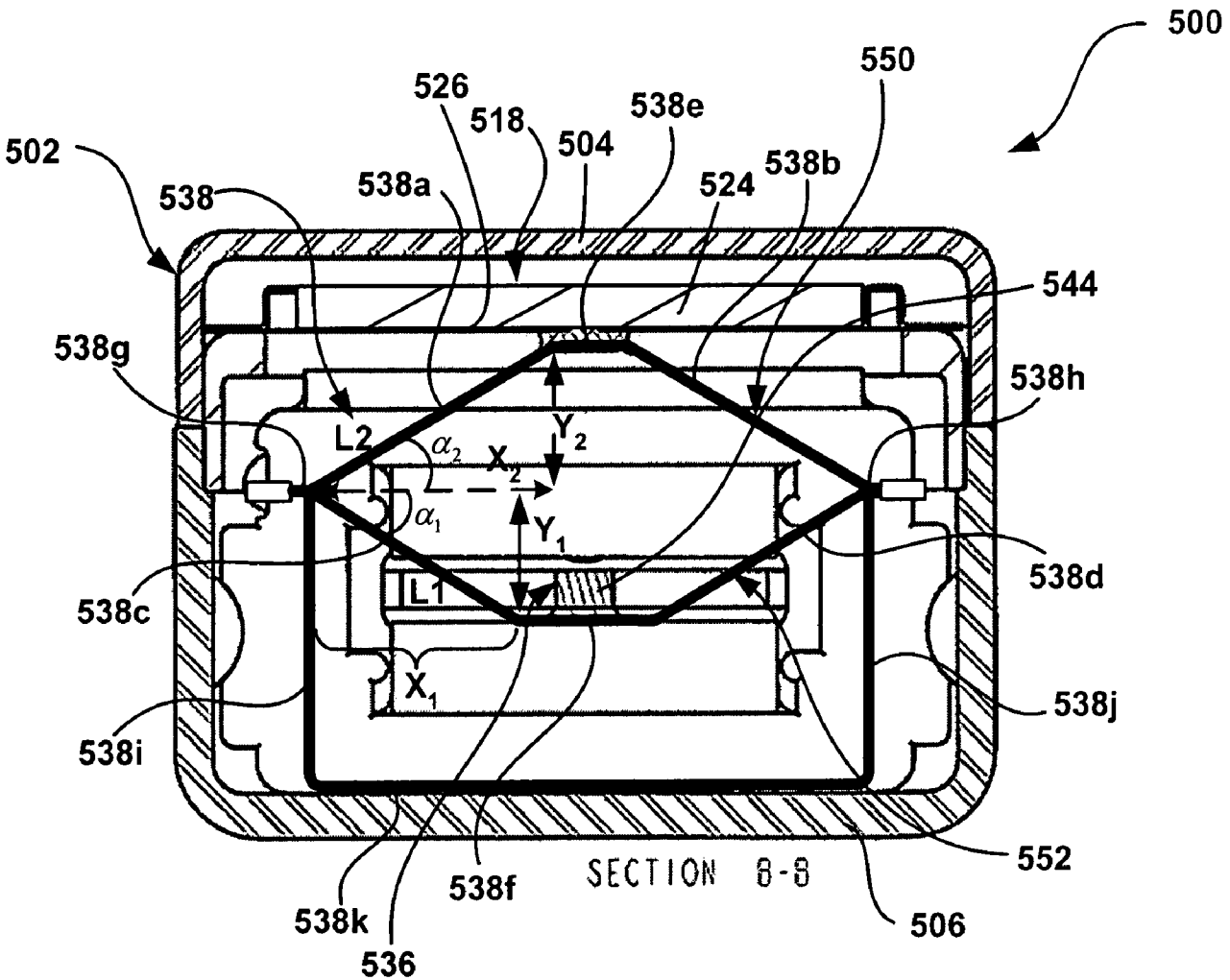

The distortions caused by unequal lengths of $L_1$ and $L_2$ in the embodiments shown in FIGS. 2 and 3 can be arranged to be equal and opposite to a new distortion caused by malting one of the horizontal span segments longer than the initial span segments, which will be discussed in the following figures. Thus, an improvement to the design shown in FIG. 3 would be to use horizontal span segments 338*e*, 338*f* of unequal lengths as shown in FIGS. 4 and 5. This strategy is explained below in connection with FIGS. 8 and 9.

FIGS. 4 and 5 illustrate third and fourth linkage assemblies 438, 538. Here, vertex 238*f* and segment 338*f* previously shown in FIGS. 2-3 between the members 238*c*, 238*d*, 338*c*, 338*d* are replaced with span segments 438*f*, 538*f* that are longer than the initial vertex 238*f* and segment 338*f*, thus shortening the length of the bottom diagonal members 438*c*, 438*d*, 538*c*, 538*d* and increasing the angle of the diagonal members 438*c*, 438*d*, 538*c*, 538*d* relative to the horizontal plane. In these configurations, the horizontal portion of the length of the members 438*a*, 438*b*, 535*a*, 538*b* is longer than the horizontal portion of the length of the members 438*c*, 438*d*, 538*c*, 538*d*. The height of the upper portions 450, 550 defined as $Y_2$ is equal to the height of the lower portions 452, 552 defined as $Y_1$. In operation, upward movement by the movable ends 444, 544 of the armatures generate an upward movement of the lower portions 452, 552, which in turn generate a horizontal outward movement of vertices 438*g*, 438*h*, 538*g*, 538*h*. The outward movement of vertices 438*g*, 435*h*, 538*g*, 538*h* causes the upper portions 450, 550 to move inwardly toward the lower portions 452, 552. This in turn, causes the diaphragms 418, 518 to move inwardly towards the movable ends 444, 544 of the armatures.

In FIGS. 4 and 5, the motion of the upper portions 450, 550 is not a linear function of the lower portions 452, 552, which in turn create harmonic distortion. The equations of motion as described in FIGS. 2 and 3 are identical to the embodiments depicted in FIGS. 4 and 5. Increasing the length of the span segments 438*f*, 538*f* vis a vis the span or vertex segments 438*e*, 538*e* changes the angles of lower members 438*c*, 438*d*, 538*c*, 538*d* thereby changing the lever ratio as calculated in equation (7).

However, the distortion caused by the span segments 438*f*, 538*f* can be arranged to be equal and opposite to the distortion caused by the difference in length of the upper diagonal members $L_2$ and the length of the lower diagonal members $L_1$ by combining the method described earlier such as lowering the upper portions 450, 550 which will be discussed in greater detail below in connection with FIGS. 8 and 9. Thus, use of a longer lower horizontal span segment 438*f*, 538*f* can be used to offset distortion caused by a non-unitary lever ratio.

Figure 6:
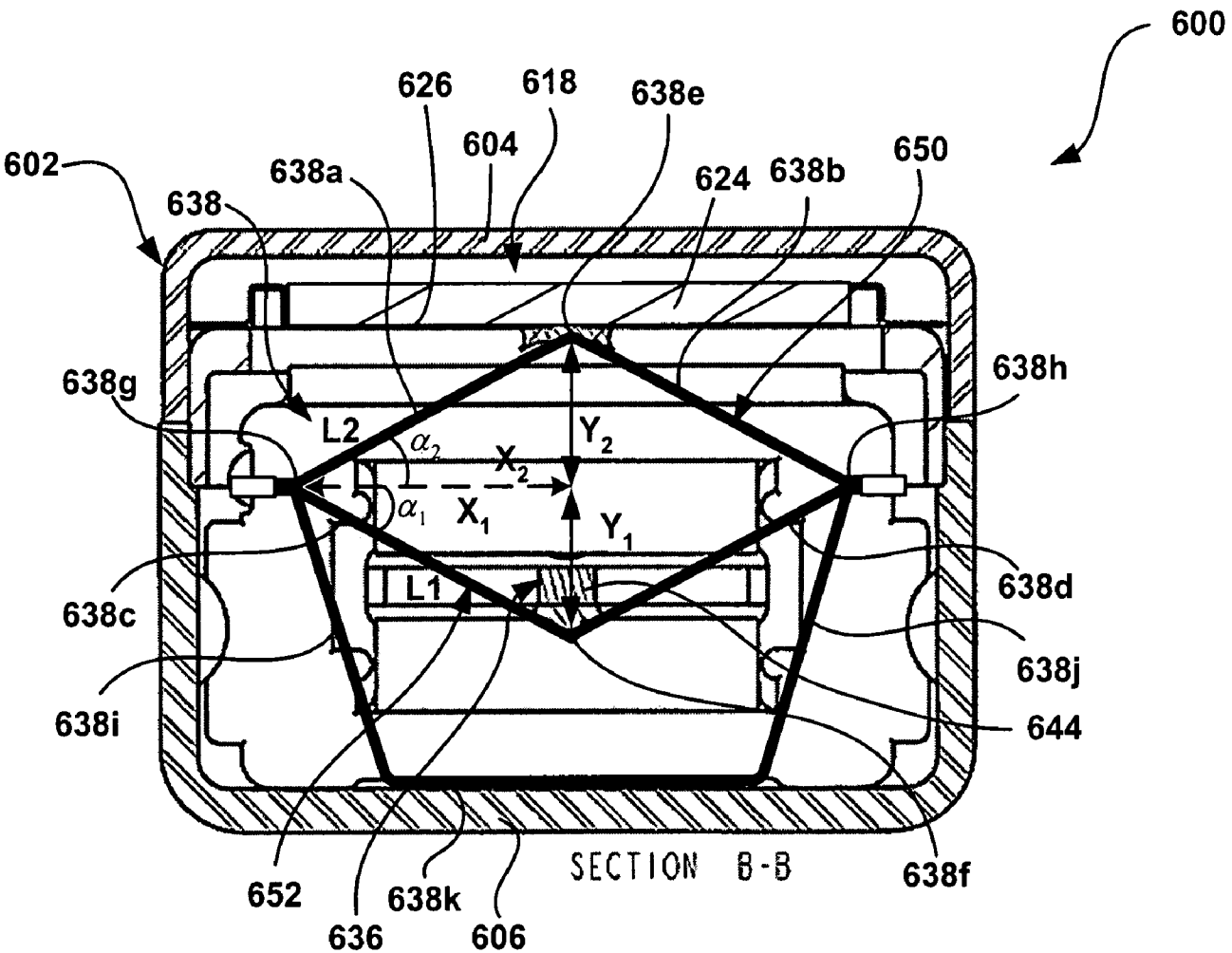
FIGS. 6-7 are cross-sectional views of two more disclosed linkage assemblies.
Figure 7:
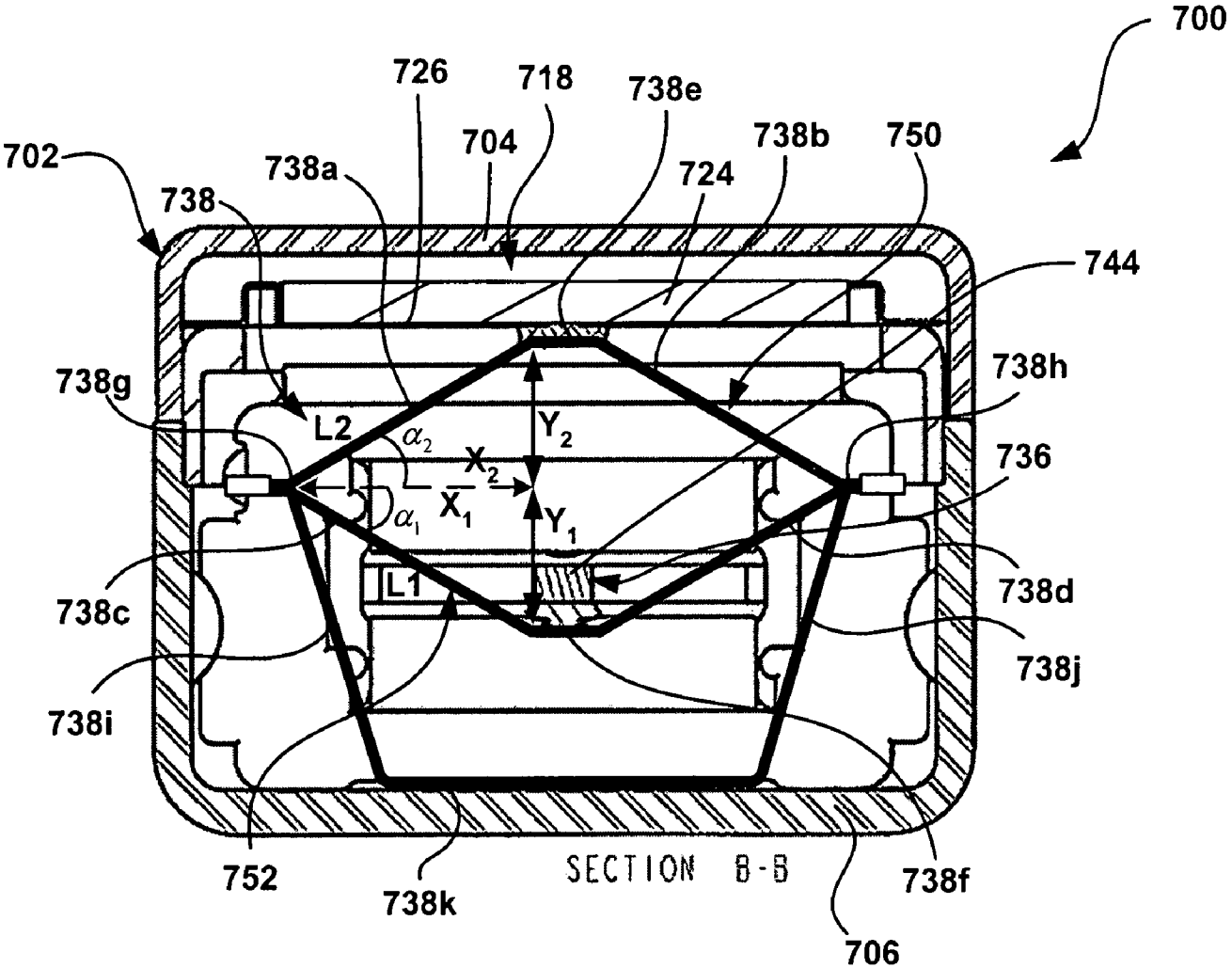

FIGS. 6 and 7 illustrate fifth and sixth linkage assemblies 638, 738. In these embodiments, the first and second legs 638*i*, 638*j*, 738*i*, 738*j* positioned within the housing 602, 702 are not perpendicular to the bases 606, 706. The height of the upper portions 650, 750 defined as $Y_2$ is equal to the height of the lower portions 652, 752 defined as $Y_1$. Further the length of the diagonal members 638*a*, 638*b*, 738*a*, 738*b* are equal to the length of the diagonal members 638*c*, 638*d*, 738*c*, 738*d*. In FIG. 6, the diagonal members 638*a*, 638*b*, 638*c*, 638*d* are connected together at the vertices 638*e*, 638*f*, 638*g*, 638*h* which have a sharp angle. In an alternative embodiment, predetermined span segments 738*e*, 738*f* are attached to the diagonal members 738*a*, 738*b*, 738*c*, 738*d*.

In operation, downward movement of the lower portions 652, 752 attached to the movable armature legs 644, 744 causes the vertices 638*g*, 638*h*, 738*g*, 738*h* to move upward as well as inward which in turn, adds upward movement of the entire upper portions 650, 750. The movement described herein in addition to the original motion depicted in FIGS. 2-3 causes the diaphragms 618, 718 to move upward at a faster rate, thereby increasing the lever ratio and the acoustic output of the transducers 600, 700.

In this configuration, the lever ratio is a function of three angles $\alpha_1$, $\alpha_2$, and the angle of the legs. In comparison to FIGS. 2-3, these angles change as the vertices move thereby introducing distortion. However, with the proper choice of L1, L2, and the length of the legs, the net change in lever ratio versus driving movement may equal to zero. This strategy is explained below in connection with FIGS. 10-11.

Figure 8:
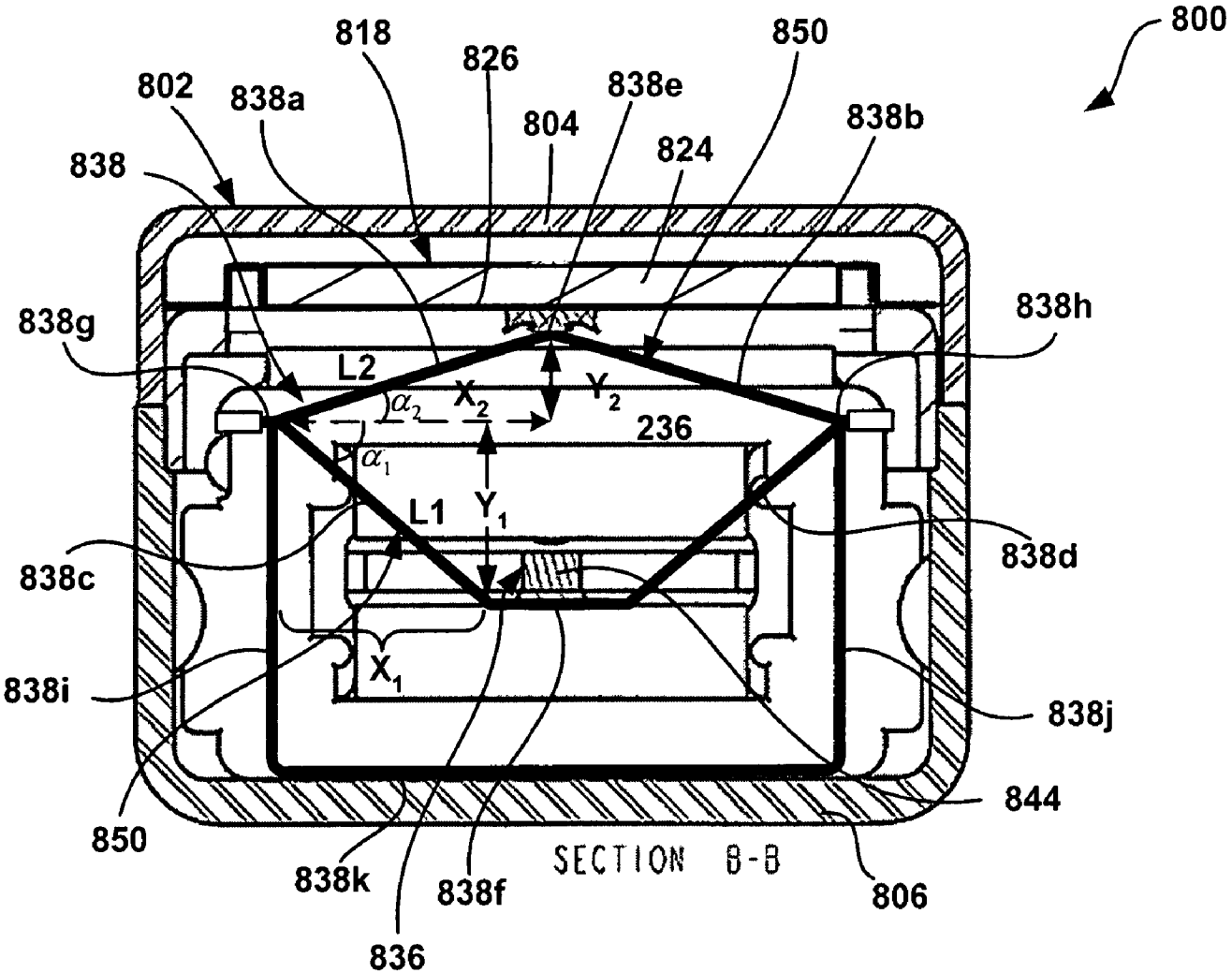
FIGS. 8-9 are cross-sectional views of two more disclosed linkage assemblies.
Figure 9:
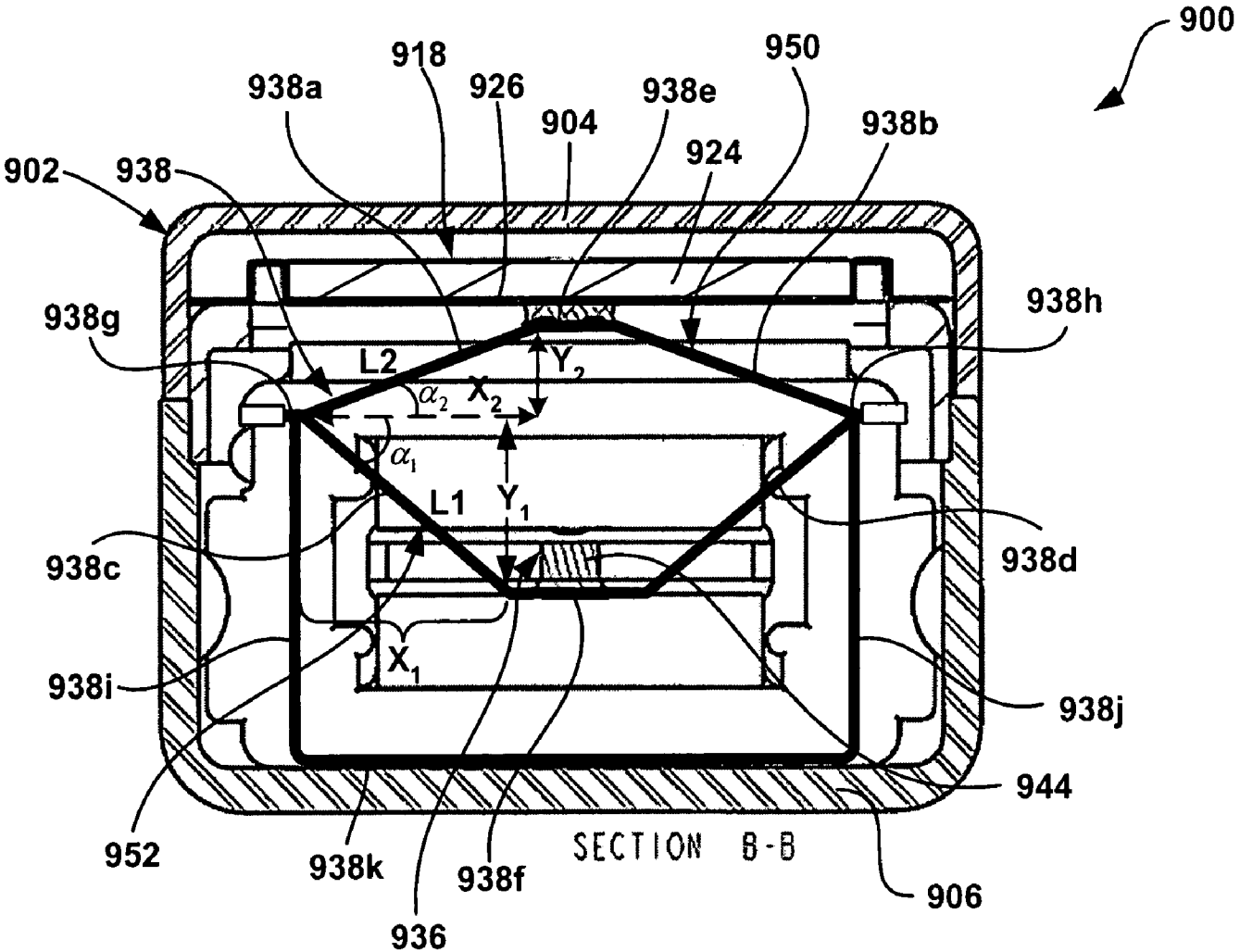

FIGS. 8 and 9 illustrate seventh and eighth linkage assemblies 838, 938 that increase the gain in the acoustic output and further reduce the harmonic distortion. Here, these configurations combine the earlier methods such that the height of the upper portions 850, 950 defined as $Y_2$ are lower than the height of the lower portions 852, 952 defined as $Y_1$. The lower portions 852, 952 are now broadened by introducing longer span segments 838*f*, 938*f* connecting between the diagonal members 838*c*, 838*d*, 938*c*, 938*d* such that the horizontal component of $L_1$ is shorter than $L_2$. The change in relative heights of the upper and lower portions and the longer span segments 838*f*, 938*f* increase the lever ratio, and consequently increase the acoustic output. The vertical legs 838*i*, 838*j*, 938*i*, 938*j* are parallel to the motion of the segments 838*f*, 938*f*. In these configurations, the distortion caused by the segments 838*f*, 938*f* can be made nearly equal and opposite to that of the distortion caused by the difference in height of the upper portions 850, 950 and lower portions 852, 952. A device built in accordance with the embodiments illustrated in FIGS. 8 and 9 has the advantages of reduced overall size, increased sound pressure output and low distortion level.

Figure 10:
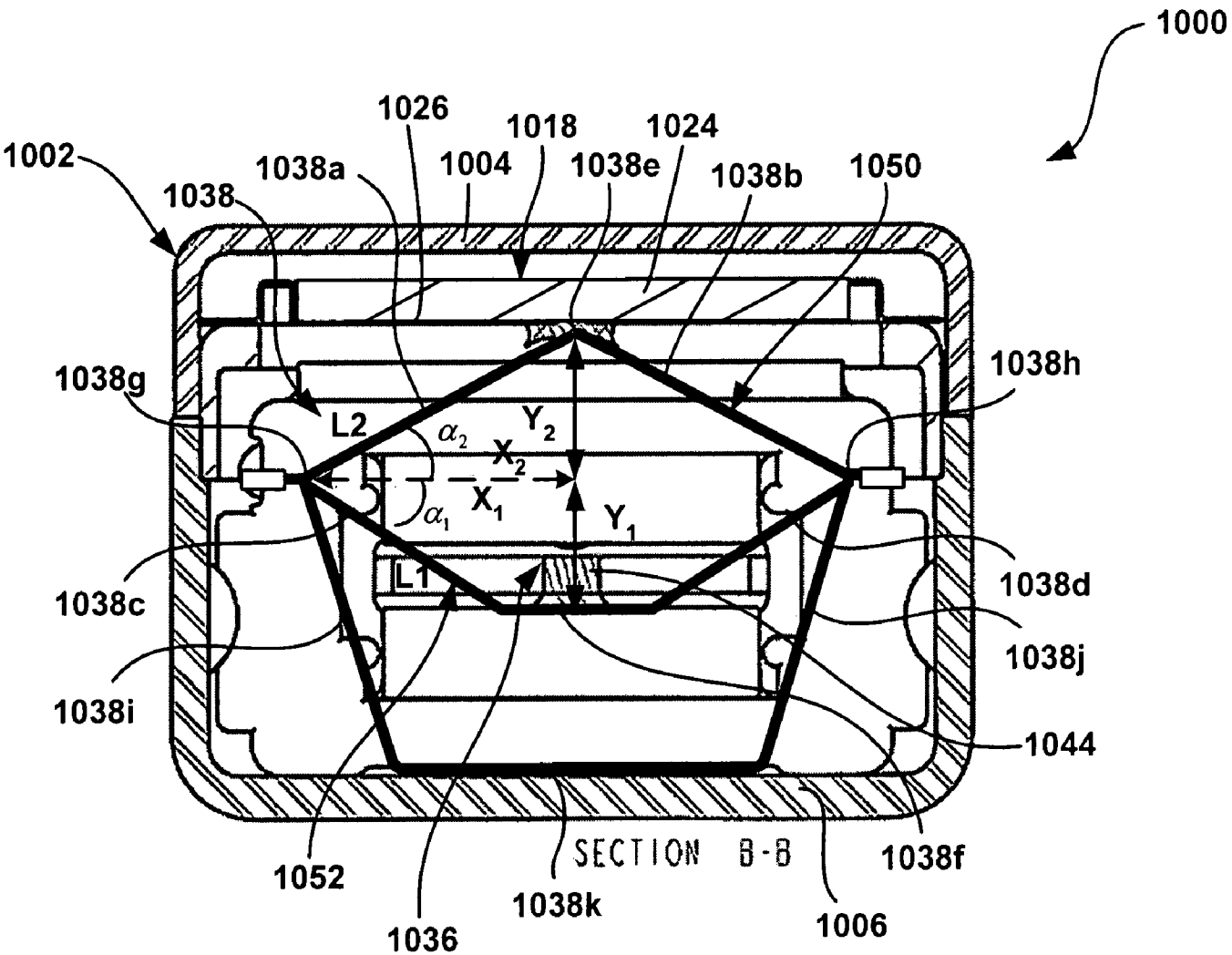
FIGS. 10-11 are cross-sectional views of two more disclosed linkage assemblies.
Figure 11:
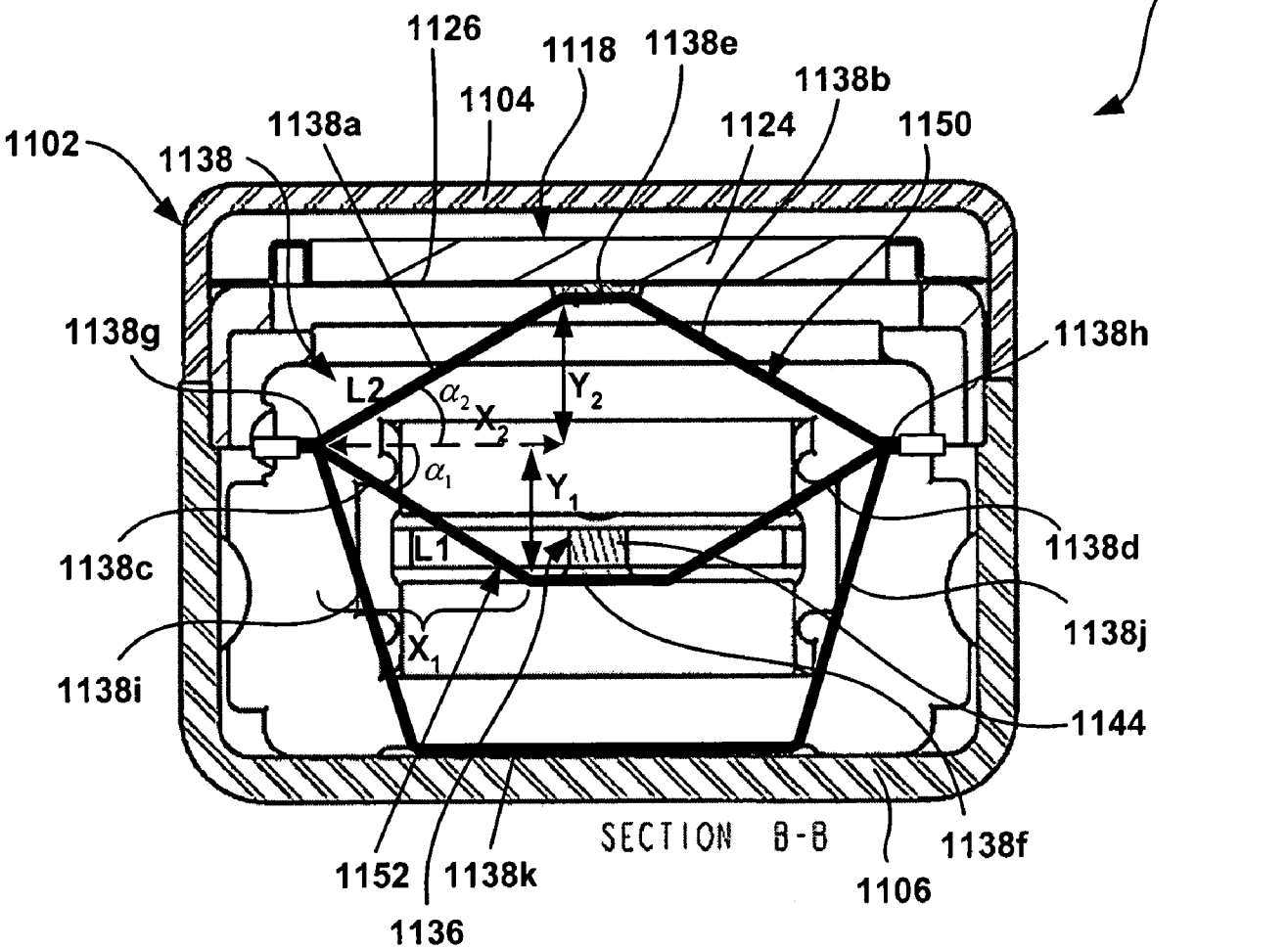

FIGS. 10 and 11 illustrate ninth and tenth linkage assemblies 1038, 1138. Here, the vertex 638*f* of FIG. 6 and the segment 738*f* of FIG. 7 have been replaced with horizontal span segments 1038*f*, 1138*f* that are longer than the vertex 638*f* and the segment 738*f* respectively, thus shortening the length of the bottom diagonal members 1038*c*, 1038*d*, 1138*c*, 1138*d* and increasing the angle of the diagonal members 1038*c*, 1038*d*, 1138*c*, 1138*d*. In these configurations, the horizontal portion of the length of the members 1038*a*, 1038*b*, 1138*a*, 1138*b* is longer than the horizontal portion of the length of the members 1038*c*, 1038*d*, 1138*c*, 1138*d*. The height of the upper portions 1050, 1150 defined as $Y_2$ are equal to the height of the lower portions 1052, 1152 defined as $Y_1$. Downward motion of the lower portions 1052, 1152 causes the vertices 1038*g*, 1038*h*, 1138*g*, 1138*h* to move upward and inward which in turn, increases the upward motion of the upper portions 1050, 1150 relative to the liege assemblies 238, 338 as depicted in FIGS. 2 and 3, thus increasing the lever ratio, and therefore the acoustic output of the transducers 1000, 1100. The distortion caused by the span segments 1038*f*, 1138*f* can be arranged to be nearly equal and opposite to the distortion caused by the nonparallel connecting legs 1038*i*, 1038*j*, 1138*i*, 1138*j*.

Figure 12:
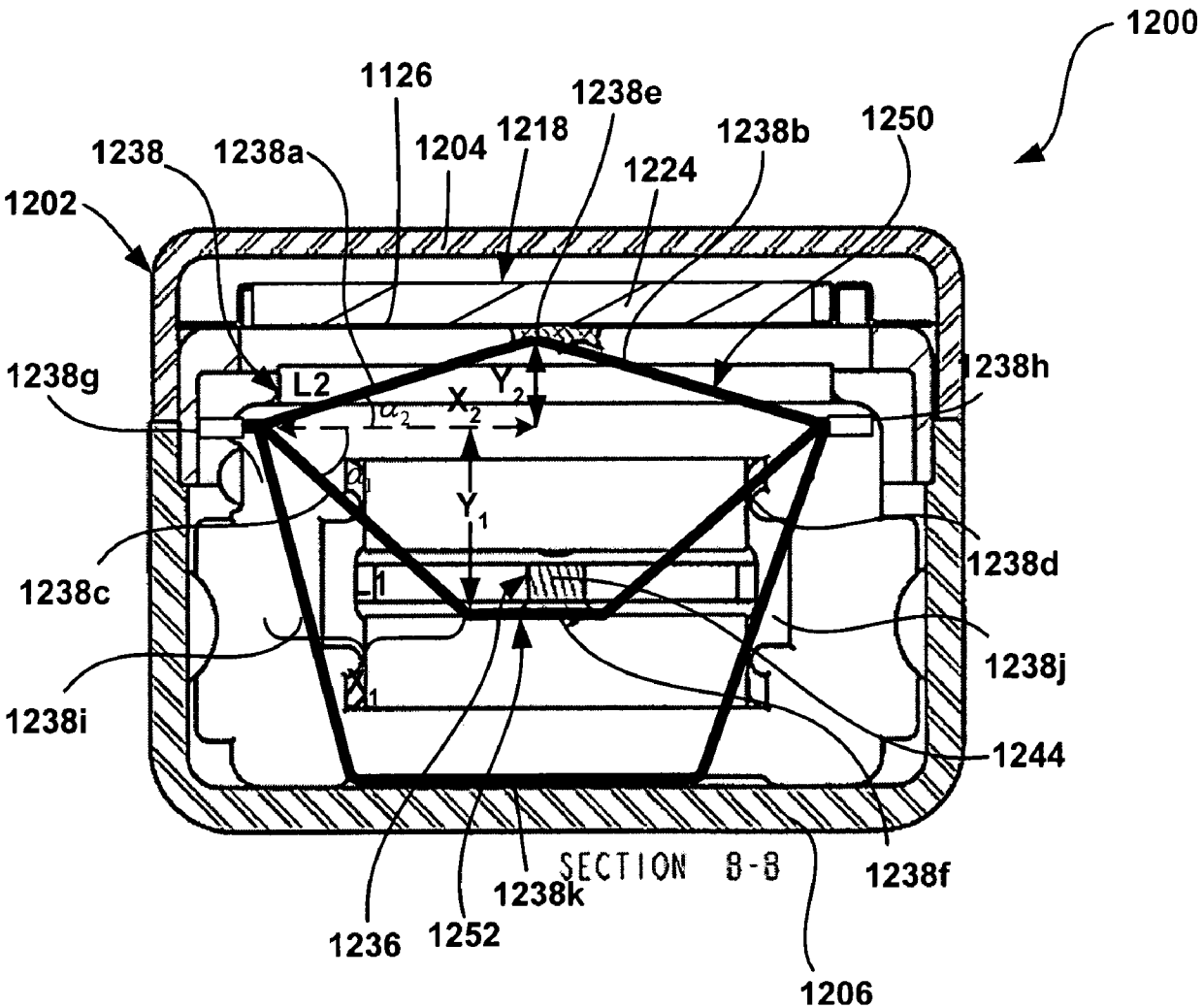
FIGS. 12-13 are cross-sectional views of two more disclosed linkage assemblies.
Figure 13:
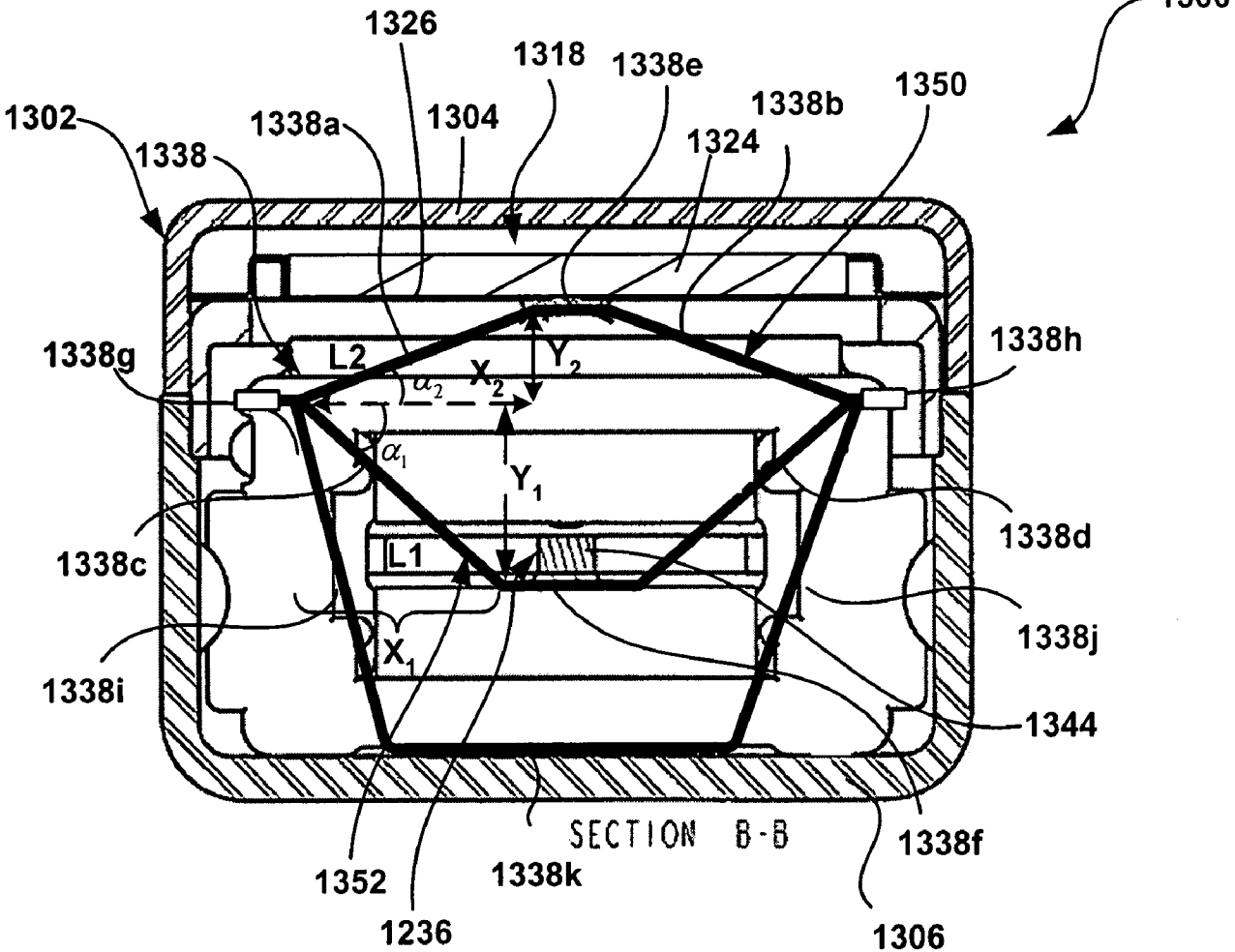

FIGS. 12 and 13 illustrate eleventh and twelfth linkage assemblies 1238, 1338 to increase the gain in the acoustic output and further reduce the harmonic distortion. Here, these configurations combine the earlier methods such that the height of the upper portions 1250, 1350 defined as $Y_2$ are lower than the height of the lower portions 1252, 1352 defined as $Y_1$. The lower portions 1252, 1352 are broadened by introducing longer span segments 1238*f*, 1338*f* connecting between the diagonal members 1238*c*, 1238*d*, 1338*c*, 1338*d* such that the horizontal portion of $L_1$ is shorter than the horizontal portion of $L_2$. The legs 1238*i*, 1238*j*, 1338*i*, 1338*j* are not parallel to each other. Combining these configurations alter both the lever ratio and the distortion. By choosing dimensions properly for each segment of the linkage, the distortion caused by each alteration can be balanced to achieve reduced overall size, increased sound pressure output, and low distortion level.

Figure 14:
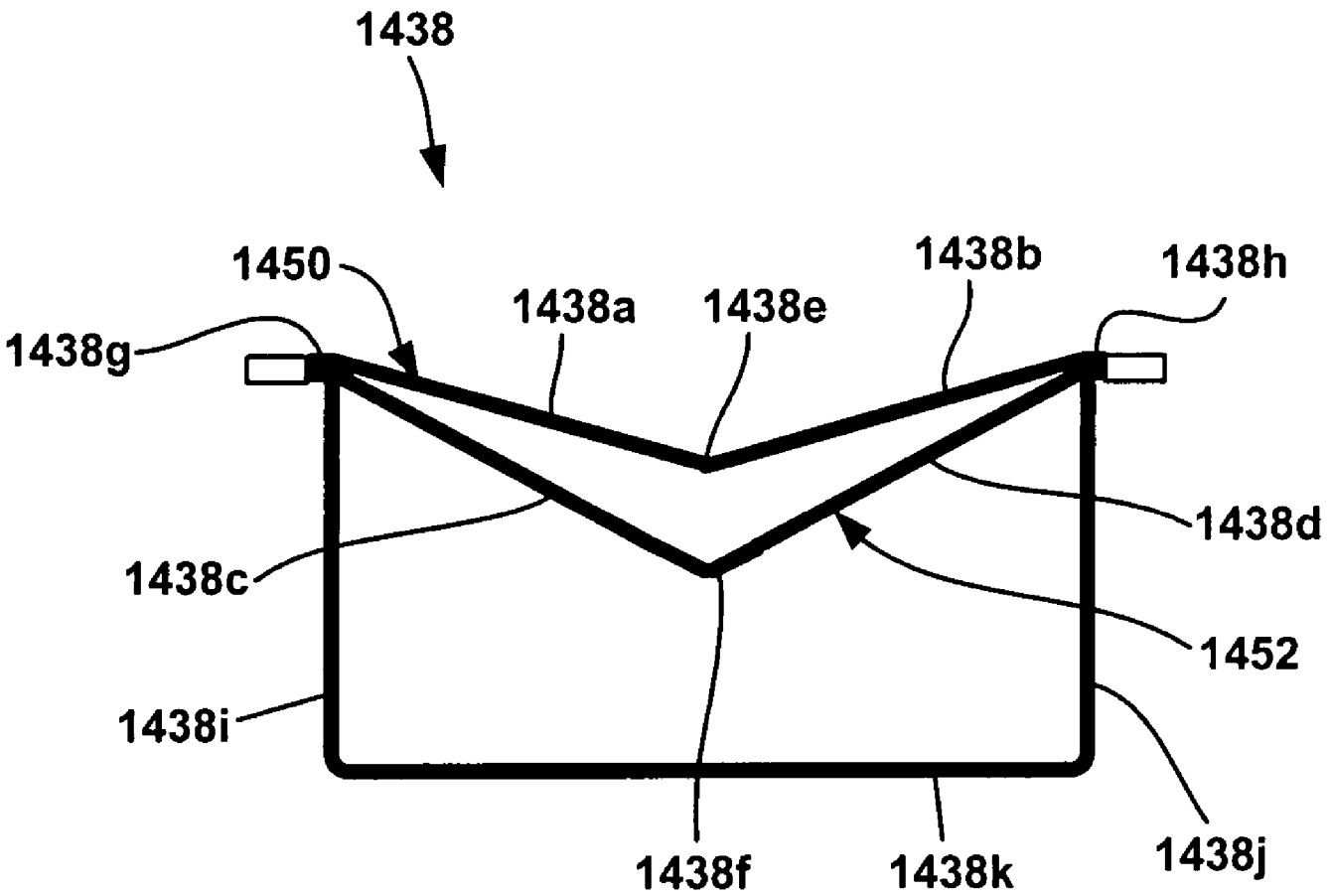
FIGS. 14-15 are cross-sectional views of two more disclosed linkage assemblies.
Figure 15:
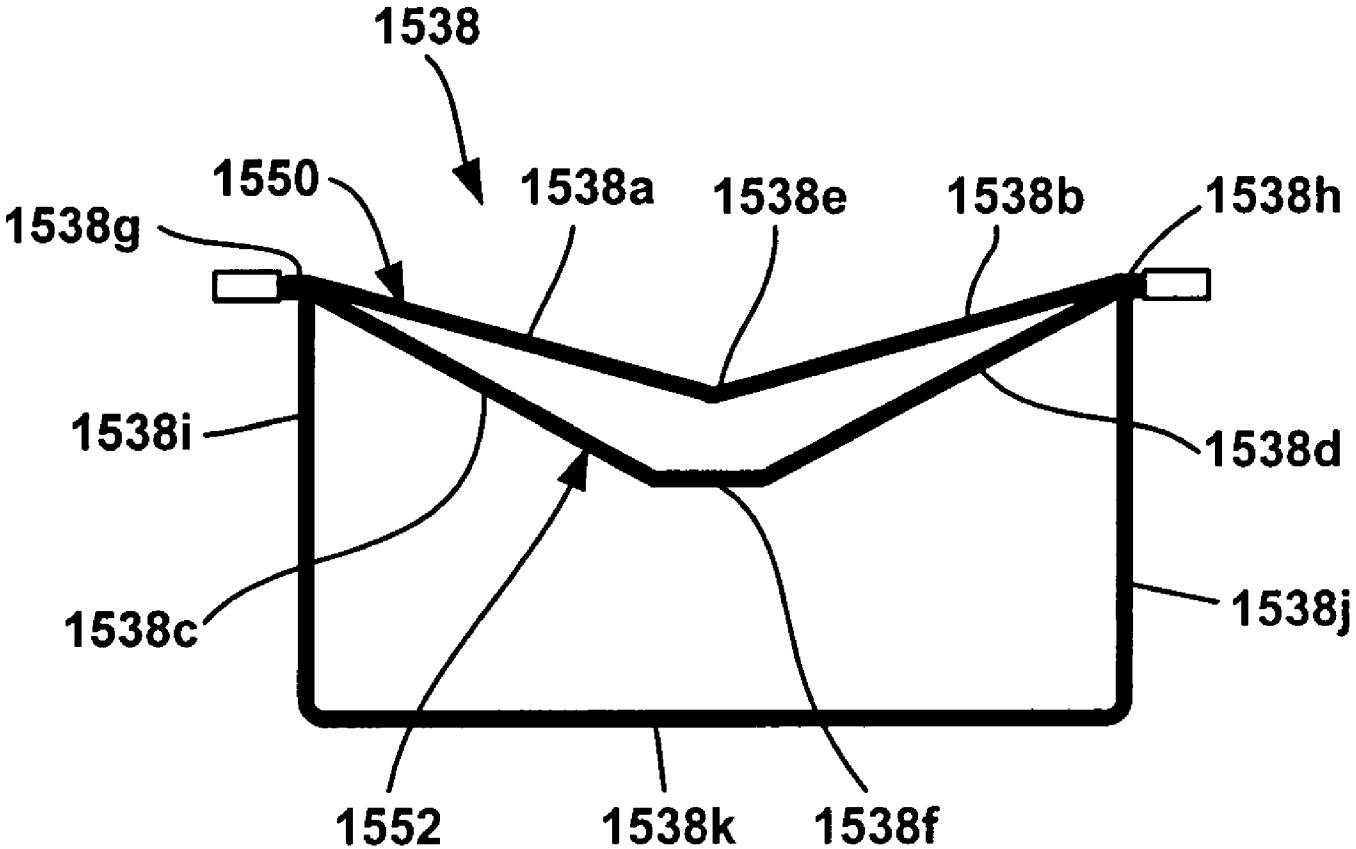

FIGS. 14 and 15 depart from the previous embodiments where the linkage assemblies 1438, 1538 provide distortion reduction with in-phase motion and reduced height. In FIGS. 14-15, the variation of the linkage assemblies 1438, 1538 are preferred for use in a loudspeaker where the linkage assemblies 1438, 1538 are positioned between a voice coil and a cone (not shown). The lower portion 1452, 1552 is connected to the voice coil (not depicted) and the upper portion 1450, 1550 is connected to the cone (not depicted). Alternatively, the lower and upper portions 1450, 1452, 1550, 1552 may be arranged in the upright position, e.g. mirrored from the initial arrangement of the lower and upper portions 1450, 1452, 1550, 1552 as depicted in FIGS. 14-15 for the same purpose.

As shown in FIG. 15, a short span 1538*f* is introduced to broaden the lower portion 1552. In an alternate embodiment, a short span 1538*e* may be introduced at the upper portion 1550 such that the members 1538*a*, 1538*b* are shorter than the members 1538*c*, 1538*d*. Yet in another embodiment, two short span segments 1538*e*, 1538*f* may be introduced at the upper and lower portions 1550, 1552. In alternate embodiments, more than one linkage assembly may be connected within the loudspeaker to provide additional stability. Multiple assemblies may be rotated such that the vertices 1438*e*, 1438*f*, 1538*e*, 1538*f* intersect at the center of the cone.

As shown and described above, by altering the lengths and angles of the various segments of the linkages, the motion of the upper portion of the linkage can be increased or decreased, as the lever ratio between the upper and lower portions is no longer equal to one which enables amplification increase or decrease. However, having a lever ratio that is not equal to one generates distortion. This disclosure addresses this problem by providing three distinct ways to compensate for distortion. In short, by combining two or more strategies for increasing or decreasing amplification, the distortions resulting from the amplification strategies may cancel each other out thereby resulting in a substantially distortion free amplification increase or decrease.

A first amplification strategy is to include a lower horizontal span segment 338*f*, 438*f*, 538*f*, 838*f*, 938*f*, 1038*f*, 1138*f*, 1238*f*, 1338*f* that extends between the segments of the lower portion and which can be used to connect the lower portion of the linkage to the movable leg of the armature. For positive amplification, this lower horizontal span segment 438*f*, 538*f*, 838*f*, 938*f*, 1038*f*, 1138*f*, 1238*f*, 1338*f* is preferably longer than a corresponding upper horizontal span segment or vertex 438*e*, 538*e*, 838*e*, 938*e*, 1038*e*, 1138*e*, 1238*e*, 1338*e* used to connect the upper portion to the diaphragm. However, making the lower horizontal span segment or vertex shorter than its upper horizontal span counterpart provide a means to reduce amplification.

A second amplification strategy is to increase the effective height $Y_1$ of the lower portion, or the distance between an imaginary line drawn between (i) the vertexes 238*g*-1338*g* and 238*b*-1338*h* that connect the upper portion 250-1350 and lower portion 252-1352 of the linkage assembly together (ii) to the lower horizontal span segment or vertex that connects the lower portion of the linkage assembly to the movable arm 244-1344 of the armature. For positive amplification or length this effective height $Y_1$ should be greater than the corresponding effective height $Y_2$ of the upper portion 250-1350 of the linkage assembly which is defined as the distance between (i) a line drawn through the vertices that connect the upper and lower portions of the linkage assembly together and (ii) the point at which the upper portion of the linkage assembly is connected to the diaphragm. Conversely, to reduce amplification, $Y_1$ should be less than $Y_2$.

A third amplification strategy is found in the nonparallel configuration of the supporting legs 638*i*, 638*j*, 738*i*, 738; 1038*i*, 1038*j*, 1138*i*, 1138*j*, 1238, 1238*j*, 1338*i*, 1338*j* that connect the vertices that connect the upper and lower portions of the linkage assembly together to the housing. By extending these legs inwardly towards each other as they extend from the vertices to the housing, an additional positive amplification effect is provided. Conversely, by extending the legs outward away from each other in a reverse non-parallel configuration would result in an amplification decrease.

Combining any two of the above three amplification techniques may result in the combination of and the substantial canceling out of the resulting distortion effects.

In summary, shortening or lengthening the height $Y_2$ in comparison to the height $Y_1$ of the linkage assembly creates a non-unity leverage ratio. When the height of the upper portion $Y_2$ is not equal to the height of the lower portion $Y_1$, the length of the upper diagonal member $L_2$ is not equal to the length of the lower diagonal member $L_1$ thereby causing harmonic distortion.

Therefore, combining any two of the following: (i) making the lower horizontal span segment 338*f*, 438*f*, 538*f*, 838*f*, 938*f*, 1038*f*, 1138*f*, 1238*f*, 1338*f* longer or shorter than its corresponding upper horizontal span segment or vertex 338*e*-1338*e*; (ii) increasing or decreasing $Y_1$ so that it is larger or smaller than $Y_2$; and (iii) using non-parallel supporting legs 638*i*, 638*j*, 738*i*, 738*j*, 1038*i*, 1038*j*, 1138*i*, 1138*j*, 1238*i*, 1238*j*, 1338*i*, 1338*j*; the harmonic distortion caused by each of these changes can be canceled out to provide for amplification or gain modification without substantial amounts of harmonic distortion.

Again, while certain specific embodiments have been illustrated and described, numerous modifications will be apparent to those skilled in the art without departing from the spirit and scope of this disclosure, which is intended to be limited only by the appended claims.

What is claimed is:

1. A transducer comprising:

a first movable member, the first movable member coupled to a linkage, the linkage coupled to a second movable member, the linkage comprising an upper portion comprising a first diagonal member and a second diagonal member, the first and second diagonal members each being coupled to the second movable member, a lower portion comprising a third diagonal member and a fourth diagonal member, the third and fourth diagonal members being coupled to the first movable member by a lower horizontal span segment, the third diagonal member also being coupled to the first diagonal member at a first vertex and the fourth diagonal member also being coupled to the second diagonal member at a second vertex, the upper portion having an upper height defined by a shortest distance between a straight line extending between the first and second vertices and a point where the first and second diagonal members are coupled to the second movable member, the lower portion having a lower height defined by a shortest distance between the line between the first and second vertices and a point along the lower horizontal span segment, the upper height being different than the lower height, the first and second vertices are coupled to a housing by first and second legs respectively that are non-parallel to each other as they extend from the first and second vertices and towards the housing.

2. The transducer of claim 1 wherein the first and second legs extend inwardly towards each other as they extend downward from the first and second vertices.

3. The transducer of claim 1 wherein the first and second legs are coupled together by a base leg that is coupled to the housing.

4. The transducer of claim 1 wherein the first and second diagonal members are coupled together at an upper vertex, the upper vertex being coupled to the second movable member, the lower horizontal span member having a length.

5. The transducer of claim 1 wherein the first and second diagonal members are coupled together at an upper horizontal span segment that is coupled to the second movable member, the upper horizontal span segment having a length that is not equal to a length of the lower horizontal span segment.

6. The transducer of claim 5 wherein the length of the lower horizontal span segment is greater than the length of the upper horizontal span segment and the lower height is greater than the upper height.

7. The transducer of claim 1 further comprising a housing that accommodates the first movable member, linkage and second movable member, the housing further comprising an opening for transmitting sound therethrough.

8. The transducer of claim 1 wherein the transducer is a receiver for a hearing aid.

9. The transducer of claim 1 wherein the transducer is a component selected from the group consisting of a receiver, microphone, speaker, accelerometer and MEMS device.

10. A transducer comprising:

a first movable member, the first movable member coupled to a linkage, the linkage coupled to a second movable member, the linkage comprising an upper portion comprising a first diagonal member and a second diagonal member, the first and second diagonal members each being coupled to the second movable member, a lower portion comprising a third diagonal member and a fourth diagonal member, the third and fourth diagonal members being coupled to the first movable member by a lower horizontal span segment, the third diagonal member also being coupled to the first diagonal member at a first vertex and the fourth diagonal member also being coupled to the second diagonal member at a second vertex, the upper portion having an upper height defined by a shortest distance between a straight line extending between the first and second vertices and a point where the first and second diagonal members are coupled to the second movable member, the lower portion having a lower height defined by a shortest distance between the line between the first and second vertices and a point along the lower horizontal span segment, the upper height being different than the lower height, the first and second diagonal members are coupled together at an upper horizontal span segment that is coupled to the second movable member, the upper horizontal span segment having a length that is not equal to a length of the lower horizontal span segment, wherein the first and second vertices are coupled to a housing by first and second legs respectively that are non-parallel to each other as they extend from the first and second vertices and towards the housing.

11. The transducer of claim 10 wherein the length of the lower horizontal span segment is greater than the length of the upper horizontal span segment, the lower height is greater than the upper height, and the first and second legs extend inwardly towards each other as they extend from the first and second vertices to the housing.

12. The transducer of claim 10 further comprising a housing that accommodates the first movable member, linkage and second movable member, the housing further comprising an opening for transmitting sound therethrough.

13. The transducer of claim 10 wherein the transducer is a receiver for a hearing aid.

14. The transducer of claim 10 wherein the transducer is a component selected from the group consisting of a receiver, microphone, speaker, accelerometer and MEMS device.

15. A transducer comprising:

a first movable member, the first movable member coupled to a linkage, the linkage coupled to a second movable member, the linkage comprising an upper portion comprising a first diagonal member and a second diagonal member, the first and second diagonal members each being coupled to the second movable member, a lower portion comprising a third diagonal member and a fourth diagonal member, the third and fourth diagonal members being coupled to the first movable member, the third diagonal member being coupled to the first diagonal member at a first vertex and the fourth diagonal member being coupled to the second diagonal member at a second vertex, the first and second vertices being coupled to a housing by first and second legs respectively that are non-parallel to each other as they extend from the first and second vertices and towards the housing.

16. The transducer of claim 15 wherein the upper portion having an upper height defined by a shortest distance between a straight line through the first and second vertices and a point where the first and second diagonal members are coupled to the second movable member, the lower portion having a lower height defined by a shortest distance between the line through the first and second vertices and a point where the third and fourth diagonal members are coupled to the first movable member, the upper height is not equal to the lower height.

17. The transducer of claim 16 wherein the third and fourth diagonal members being coupled to the first movable member and together at the first movable member by a lower horizontal span segment, the first and second diagonal members are coupled together at an upper horizontal span segment that is coupled to the second movable member, the upper horizontal span segment having a length that is not equal to a length of the lower horizontal span segment.

18. The transducer of claim 17 wherein the length of the lower horizontal span segment is greater than the length of the upper horizontal span segment, the lower height is greater than the upper height and the first and second legs extend inwardly towards each other as they extend from the first and second vertices towards the housing.

19. The transducer of claim 15 wherein the first and second legs extend inwardly towards each other as they extend from the first and second vertices towards the housing.

20. The transducer of claim 15 wherein the first and second diagonal members are coupled together at an upper vertex, the upper vertex being coupled to the second movable member, and the third and fourth diagonal members being coupled to the first movable member and together at the first movable member by a lower horizontal span segment having a length.

21. The transducer of claim 15 wherein the third and fourth diagonal members being coupled to the first movable member and together at the first movable member by a lower horizontal span segment, the first and second diagonal members are coupled together and to the second movable member by an upper horizontal span segment, the upper horizontal span segment having a length that is not equal to a length of the lower horizontal span segment.

22. The transducer of claim 15 wherein the housing comprises an opening for transmitting sound therethrough.

23. The transducer of claim 15 wherein the transducer is a receiver for a hearing aid.

24. The transducer of claim 15 wherein the transducer is a component selected from the group consisting of a receiver, microphone, speaker, accelerometer and MEMS device.

25. A transducer comprising:

a first movable member, the first movable member coupled to a linkage, the linkage coupled to a second movable member, the linkage comprising an upper portion comprising a first diagonal member and a second diagonal member, the first and second diagonal members each being coupled to the second movable member by an upper horizontal span segment, the upper horizontal span segment having a length, a lower portion comprising a third diagonal member and a fourth diagonal member, the third and fourth diagonal members being coupled to the first movable member by a lower horizontal span segment having a length that is not equal to the length of the upper horizontal span segment, the third diagonal member also being coupled to the first diagonal member at a first vertex and the fourth diagonal member also being coupled to the second diagonal member at a second vertex, the first and second vertices being coupled to a housing by first and second legs respectively that the first and second vertices and towards the housing in a non-parallel fashion, the upper portion having an upper height defined by a shortest distance between a line through the first and second vertices and a point where the first and second diagonal members are coupled to the second movable member, the lower portion having a lower height defined by a shortest distance between the line through the first and second vertices and a point where the third and fourth diagonal members are coupled to the first movable member, the upper height not being equal to the lower height.

26. The transducer of claim 25 wherein the housing comprises an opening for transmitting sound therethrough.

27. The transducer of claim 25 wherein the transducer is a receiver for a hearing aid.

28. The transducer of claim 25 wherein the transducer is a component selected from the group consisting of a receiver, microphone, speaker, accelerometer and MEMS device.

29. A method for amplifying the output of a transducer and compensating for distortion, the method comprising:

providing a transducer comprising a first movable member coupled to a linkage, and the linkage coupled to a second movable member, providing the linkage with an upper portion comprising a first diagonal member and a second diagonal member, the first and second diagonal members each being coupled to the second movable member by an upper horizontal span segment having a length, a lower portion of the linkage comprising a third diagonal member and a fourth diagonal member, the third and fourth diagonal members being coupled to the first movable member by a lower horizontal span segment having a length, the third diagonal member being coupled to the first diagonal member at a first vertex and the fourth diagonal member being coupled to the second diagonal member at a second vertex, the upper portion having an upper height defined by a shortest distance between a straight line through the first and second vertices and a point where the first and second diagonal members are coupled to the second movable member, the lower portion having a lower height defined by a shortest distance between the line through the first and second vertices and a point along the lower horizontal span segment, adjusting the upper height so that it is not equal to the lower height, adjusting the length of the lower horizontal segment so that it is not equal to length of the upper horizontal span segment, and attaching the first and second vertices to the housing with first and second legs to the housing in a manner so that the first and second legs extend from the first and second vertices and towards the housing in a non-parallel fashion.

30. A method for amplifying the output of a transducer and compensating for distortion, the method comprising:

providing a transducer comprising a first movable member coupled to a linkage, and the linkage coupled to a second movable member, providing the linkage with an upper portion comprising a first diagonal member and a second diagonal member, the first and second diagonal members each being coupled to the second movable member, a lower portion of the linkage comprising a third diagonal member and a fourth diagonal member, the third and fourth diagonal members being coupled to the first movable member, the third diagonal member being coupled to the first diagonal member at a first vertex and the fourth diagonal member also being coupled to the second diagonal member at a second vertex, the first and second vertices being coupled to a housing by first and second legs respectively, and attaching the first and second legs to the housing so that they extend from the first and second vertices and towards the housing in a non-parallel fashion.

31. The method of claim 30, wherein the upper portion has an upper height defined by a shortest distance between a straight line through the first and second vertices and a point where the first and second diagonal members are coupled to the second movable member, the lower portion has a lower height defined by a shortest distance between the line through the first and second vertices and a point where the third and fourth diagonal members are coupled to the first movable member, the method further comprising adjusting the upper height so that it is not equal to the lower height.

32. The method of claim 30, wherein the first and second diagonal members are connected to the second movable member by an upper horizontal span segment and the third and fourth diagonal members are connected to the first movable member by a lower horizontal span segment, the method further comprising adjusting a length of the lower horizontal segment so that it is not equal to a length of the upper horizontal span segment.

33. A method for amplifying the output of a transducer and compensating for distortion, the method comprising:

providing a transducer comprising a first movable member coupled to a linkage, and the linkage coupled to a second movable member, providing the linkage with an upper portion comprising a first diagonal member and a second diagonal member, the first and second diagonal members each being coupled to the second movable member by an upper horizontal span segment having a length, a lower portion of the linkage comprising a third diagonal member and a fourth diagonal member, the third and fourth diagonal members being coupled to the first movable member by a lower horizontal span segment having a length, the third diagonal member being coupled to the first diagonal member at a first vertex and the fourth diagonal member also being coupled to the second diagonal member at a second vertex, the first and second vertices being coupled to a housing by first and second legs respectively, the upper portion having an upper height defined by a shortest distance between a straight line through the first and second vertices and a point where the first and second diagonal members are coupled to the second movable member, the lower portion having a lower height defined by a shortest distance between the line through the first and second vertices and a point along the lower horizontal span segment, adjusting the length of the lower horizontal segment so that it is not equal to the length of the upper horizontal span segment, attaching the first and second legs to the housing so that they not parallel to each other as they extend from the first and second vertices and towards the housing, and adjusting the upper height so that it is not equal to the lower height.

* * * * *

UNITED STATES PATENT AND TRADEMARK OFFICE

CERTIFICATE OF CORRECTION

PATENT NO. : 7,366,317 B2
APPLICATION NO. : 10/967959
DATED : April 29, 2008
INVENTOR(S) : Thomas E. Miller et al.

It is certified that error appears in the above-identified patent and that said Letters Patent is hereby corrected as shown below:

At Column 15, line 33, "30," should be -- 30 --.

At Column 16, line 35, "they not" should be -- they are not --.

Signed and Sealed this

Sixteenth Day of September, 2008

JON W. DUDAS
*Director of the United States Patent and Trademark Office*